US010253600B2

(12) United States Patent
Lu et al.

(10) Patent No.: US 10,253,600 B2
(45) Date of Patent: Apr. 9, 2019

(54) PARALLEL NETWORK SIMULATION APPARATUS, METHODS, AND SYSTEMS

(75) Inventors: Qin Lu, Katy, TX (US); Graham Fleming, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 441 days.

(21) Appl. No.: 14/406,805

(22) PCT Filed: Jun. 15, 2012

(86) PCT No.: PCT/US2012/042728
§ 371 (c)(1),
(2), (4) Date: Dec. 10, 2014

(87) PCT Pub. No.: WO2013/187915
PCT Pub. Date: Dec. 19, 2013

(65) Prior Publication Data

US 2015/0134314 A1 May 14, 2015

(51) Int. Cl.
*E21B 43/00* (2006.01)
*E21B 47/00* (2012.01)
*E21B 47/10* (2012.01)

(52) U.S. Cl.
CPC ..... *E21B 43/00* (2013.01); *E21B 47/00* (2013.01); *E21B 47/10* (2013.01)

(58) Field of Classification Search
CPC ..... E21B 43/00; E21B 47/10; E21B 47/00
See application file for complete search history.

(56) References Cited

U.S. PATENT DOCUMENTS 7,668,707 B2 2/2010 Watts, III et al.
2010/0082724 A1 4/2010 Diyankov et al.
(Continued)

FOREIGN PATENT DOCUMENTS

WO WO-2011/100002 A1 8/2011
WO WO-2013187915 A2 12/2013
WO WO-2013187915 A3 12/2013

OTHER PUBLICATIONS

"Australian Application Serial No. 2012382415, Response filed Jul. 30, 2015 to First Examiners Report dated Jun. 26, 2015", 4 pgs.
(Continued)

*Primary Examiner* — Aniss Chad
*Assistant Examiner* — Steven W Crabb
(74) *Attorney, Agent, or Firm* — Gilliam IP PLLC

(57) ABSTRACT

In some embodiments, systems, methods, and articles may operate to compute, in parallel, to determine values of unknowns in network equations associated with a network of sub-surface wells and at least one surface facility, for intra-well subdivisions of the network, and then for inter-well subdivisions of the network, wherein the computing is based on default values of the unknowns, or prior determined values of the unknowns. Additional activities may include constructing a distributed Jacobian matrix having portions comprising coefficients of the unknowns distributed among a number of processors, wherein each of the portions is distributed to a particular one of the processors previously assigned to corresponding ones of the subdivisions. The Jacobian matrix may be factored to provide factors and eliminate some of the unknowns. Back-solving is used to determine remaining unsolved ones of the unknowns, using the factors. Additional apparatus, systems, and methods are described.

23 Claims, 6 Drawing Sheets

(56) References Cited

U.S. PATENT DOCUMENTS

| | | | | |
|---|---|---|---|---|
| 2011/0040536 | A1 | 2/2011 | Levitan | |
| 2011/0046927 | A1 | 2/2011 | Jeong et al. | |
| 2011/0098998 | A1* | 4/2011 | Lunati | E21B 49/00 703/10 |
| 2012/0059639 | A1* | 3/2012 | Fung | G06F 17/5018 703/10 |
| 2012/0136641 | A1* | 5/2012 | Fung | E21B 43/00 703/10 |
| 2012/0203515 | A1* | 8/2012 | Pita | E21B 49/00 703/2 |
| 2012/0296619 | A1* | 11/2012 | Maliassov | E21B 43/00 703/10 |

OTHER PUBLICATIONS

"European Application Serial No. 12878865.0, Extended European Search Report dated Jun. 28, 2016", 7 pgs.
"Russian Application Serial No. 2014149896, Office Action dated Jun. 7, 2016", (w/ English Translation), 16 pgs.
"Russian Application Serial No. 2014149896, Response filed Aug. 22, 2016 to Office Action dated Jun. 7, 2016", (w/ English Translation of Claims), 15 pgs.
"Australian Application Serial No. 2012382415, First Examiners Report dated Jun. 26, 2015", 3 pgs.
"European Application Serial No. 12878865.0, Office Action dated Jan. 30, 2015", 3 pgs.
"European Application Serial No. 12878865.0, Response filed Apr. 7, 2015 to Office Action dated Jan. 30, 2015", 11 pgs.
"International Application Serial No. PCT/US2012/042728, Response filed Apr. 15, 2014 to Written Opinion dated Feb. 1, 2013", 3 pgs.
"Canadian Application Serial No. 2,876,583, Office Action dated Dec. 21, 2015", 3 pgs.
"Canadian Application Serial No. 2,876,583, Response filed Mar. 10, 2016 to Office Action dated Dec. 21, 2015", 11 pgs.
"International Application Serial No. PCT/US2012/042728, International Preliminary Report on Patentability dated Jun. 9, 2014", 9 pgs.
"International Application Serial No. PCT/US2012/042728, International Search Report dated Feb. 1, 2013", 2 pgs.
"International Application Serial No. PCT/US2012/042728, Written Opinion dated Feb. 1, 2013", 5 pgs.
Coats, B. K, et al., "A Generalized Wellbore and Surface Facility Model, Fully Coupled to a Reservoir Simulator", SPE Reservoir Evaluation & Engineering, 7(2), (Apr. 2004), 132-142.
Shiralkar, G. S, et al., "An Efficient Formulation for Simultaneous Solution of the Surface Network Equations", SPE Reservoir Simulation Symposium, Jan. 31-Feb. 2, 2005, The Woodlands, Texas, (2005), 1-6.
Watts, J. W, et al., "Determination of Active Constraints in a Network", SPE Reservoir Simulation Symposium, Feb. 2-4, 2009, The Woodlands, Texas, (2009), 1-12.
"Russian Application Serial No. 2014149896, Office Action dated Sep. 14, 2016.", 7 pages.
"European Application Serial No. 12878865.0, Office Action dated Aug. 4, 2017", 8 pages.
EP Application Serial No. 12878865.0; Communication Pursuant to Article 94(3); dated May 2, 2018, 4 pages.

* cited by examiner

PARALLEL NETWORK SIMULATION APPARATUS, METHODS, AND SYSTEMS

PRIORITY APPLICATIONS

This application is a U.S. National Stage Filing under 35 U.S.C. 371 from International Application No. PCT/US2012/042728, filed on 15 Jun. 2012, and published as WO 2013/187915 on 19 Dec. 2013; which application and publication is incorporated herein by reference in their entirety.

BACKGROUND

Understanding the structure and properties of geological formations can reduce the cost of drilling wells for oil and gas exploration. In some cases, this understanding is assisted by simulating reservoir behavior, including the network of wells and facilities that access a particular reservoir.

In existing reservoir simulators, the network simulation is performed sequentially, i.e. only one processor solves the entire network, or all processors solve the same network redundantly. Prior to simulation, processors are assigned to one or more reservoir grid blocks (where each processor has a domain within the reservoir), and thereafter, the processors operate in parallel to solve the reservoir behavior equations using inter-processor communication techniques.

This approach raises a parallel scalability problem: when the number of processors increases, the CPU (central processing unit) time of individual processors and the elapsed time spent on reservoir grid computations decreases accordingly, but the overall CPU time for the network simulation stays relatively constant. As a result, the total CPU time (and therefore, the elapsed simulation time), is not scalable to any significant degree.

DETAILED DESCRIPTION

Fluid flow rates, fluid compositions, and pressure distributions within a network of sub-surface wells can be simulated using numerical models. Thus, the solution of the models can be used to provide a behavioral simulation of the reservoir grid, coupled to a network of the wells and related surface facilities.

To provide better scaling and speed up simulation performance, the apparatus, systems, and methods described herein are used to solve the entire network numerical model in parallel, so that the CPU time of individual processors and the total elapsed time of network simulation can be reduced when compared to traditional sequential simulation. In this way, true parallel scalability of the overall reservoir-network simulation can be achieved. A more detailed description of the inventive mechanism used in some embodiments will now be provided.

Figure 1:
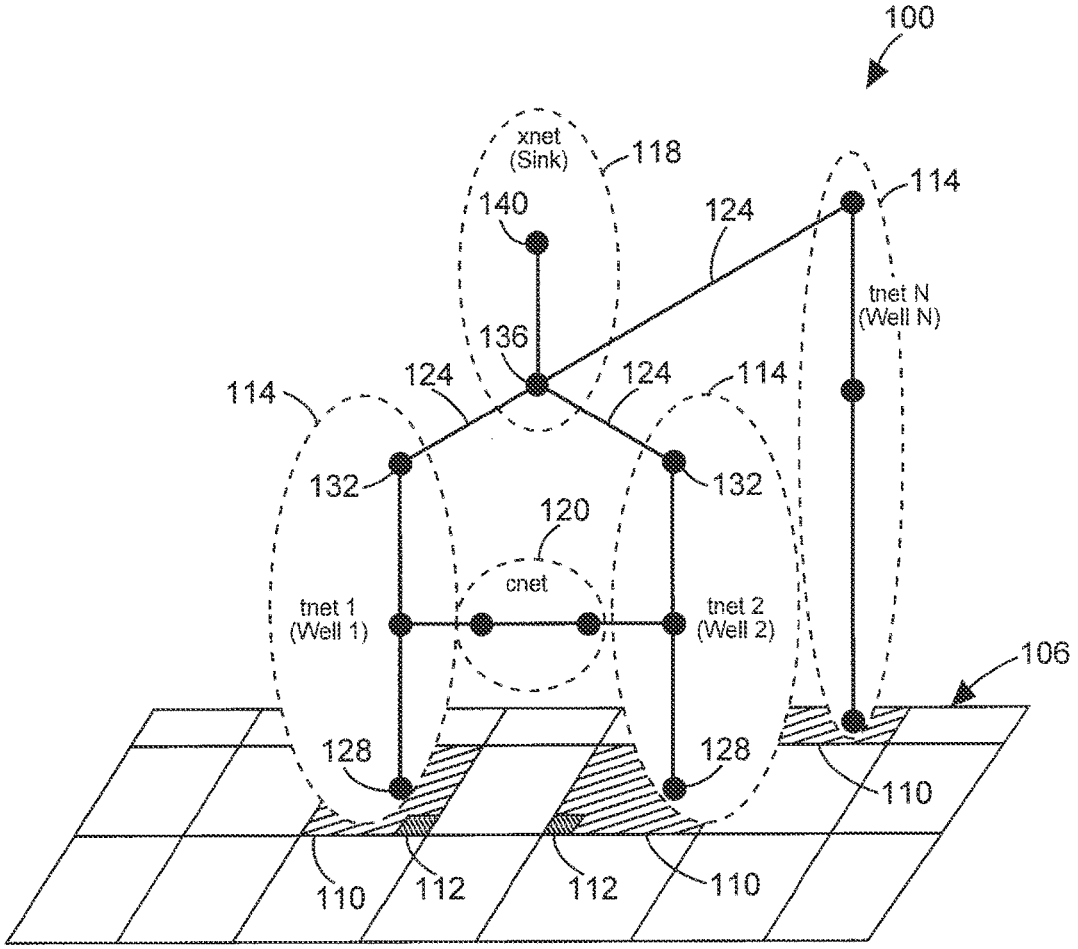
FIG. 1 is a diagram of a network of sub-surface wells and at least one surface facility, including intra-well (tnet) subdivisions of the network, and inter-well (xnet) subdivisions of the network, according to various embodiments of the invention.

FIG. 1 is a diagram of a network 100 of sub-surface wells (Well1, Well2, . . . , WellN) and at least one surface facility (e.g., a Sink, such as a holding tank), including intra-well (tnet1, tnet2, . . . , tnetN) subdivisions of the network 100, and inter-well (xnet) subdivisions of the network 100, according to various embodiments of the invention. A reservoir simulator may operate to couple the simulation of reservoir sub-grids 110 and grid blocks 112, and the simulation of the network of wells (e.g., Well1, Well2, . . . , WellN) and surface facilities (e.g., Sink).

The wells Well1, Well2, . . . , WellN perforate the reservoir grid blocks 112, via nodes (shown as large black dots in the figure) inside the reservoir grid 106. The nodes represent physical objects/locations at which the wells Well1, Well2, . . . , WellN can produce or inject fluid. The network 100 often has a tree-like structure, with each branch of the tree structure being a well. Fluid from the wells Well1, Well2, . . . , WellN may flow directly to sinks (e.g., storage tanks), or flow from sources, or join at one or more common gathering centers.

Parallel computing is a useful paradigm in modern numerical simulation. One method commonly used to parallelize a numerical problem is to subdivide the problem into multiple domains, so that computations can be performed in parallel over each domain. This mechanism utilizes communication among the domain processors for those calculations that require the transfer of information between domains.

For example, the reservoir grid 106 shown in FIG. 1 could be divided into several sub-grids 110, each of which represents a computational domain and contains one or more grid blocks 112, and any calculation that involves only local variables, such as evaluation of the fluid properties within that domain, can be performed in parallel with other domains. Thus, for these local calculations, each processor only performs calculations for part of the reservoir. In this way, the CPU time used by each processor, and the elapsed time to solve the whole problem, can be reduced when compared to performing the calculations for each domain serially, on a single processor. However, calculations that depend on variables that reside on different sub-grids 110, such as determining the flow rate between grid blocks 112 on the boundaries of the sub-grids 110, utilize communication between processors, and if these calculations are more than a small fraction of the total calculations, the time required to communicate information between processors may result in poor parallel scalability. For this reason, the benefit of adding more processors often declines as the number of processors increases.

In addition, there is often some part of the calculations that cannot readily be subdivided, and which must either be solved on a single processor (with the results communicated to all other processors), or solved on all processors simultaneously. This arrangement is sometimes referred to as sequential (or serial) computing. To provide good parallel scalability, the amount of sequential computation used to provide a simulation should be relatively small. Most conventional approaches to solving the equations for surface networks use a relatively large amount of sequential processing, as is well known to those of ordinary skill in the art. Those that wish to learn more about such conventional approaches can refer to B. K. Coats, G. C. Fleming, J. W.

Watts, M. Ramé and G. S. Shiralkar, "A Generalized Wellbore and Surface Facility Model, Fully Coupled to a Reservoir Simulator" SPE-87913-PA, *SPE Journal* 7(2): 132-142, April, 2004 [Reference 1]; and G. S. Shiralkar and J. W. Watts, "An Efficient Formulation for Simultaneous Solution of the Surface Network Equations." SPE-93073, presented at the *SPE Symposium on Reservoir Simulation*, Houston, Tex., Jan. 31-Feb. 2, 2005 [Reference 2].

In the discussion that follows, it should be noted that the network 100 includes wells Well1, Well2, . . . , WellN, connected pipelines, and surface facilities. The network 100 also includes connections 124 and nodes (represented by large black dots). Some types of connections 124 include well tubing strings, pipes, valves, chokes (that reduce the flow in a pipe by reducing diameter), and pumps, among others. Some types of nodes include perforation inlets (sources) 128, perforation outlets, tubing heads 132, gathering centers 136, distribution centers 140, separators, coolers, heaters, and fractionation columns, among others.

Produced or injected fluid streams flow through the connections 124 and join at the nodes. Boundary conditions are set by network sink and source pressures, source fluid compositions, perforated reservoir grid block pressures, and fluid mobilities. Network equations include connection equations imposed at connections, perforation equations imposed at perforations, and mass balance equations imposed at nodes. In various embodiments of the invention, a set of processors can be set up to solve for the network unknowns in parallel, so that the unknowns include the pressures and fluid compositions at nodes, the total fluid flow rates at connections 124, and the total fluid flow rates at perforations 128. These equations are linearized and solved using a number of Newton iterations.

Various facility constraints can be imposed at different points within the network, such as a maximum flow rate constraint at a connection, a maximum flow rate constraint on the sum of flow rates of a group of connections, or a minimum pressure constraint at a node, etc. A slack variable solution method, known to those of ordinary skill in the art, can be applied to determine which constraints are active during an iterative network solution procedure.

Those that desire further information on methods that use slack variables to determine active constraints within a network are encouraged to refer to "Systems and Methods for the Determination of Active Constraints in a Network using Slack Variables," J. W. Watts, et al., U.S. Pat. No. 7,668,707, incorporated herein by reference in its entirety [Reference 3]. Also, "Determination of Active Constraints in a Network," J. W. Watts, et al., SPE-118877-PA, presented at the SPE Symposium on Reservoir Simulation, Woodlands, Tex., Feb. 2-4, 2009 [Reference 4].

As noted previously, the network 100 can be divided into sub-networks. Each sub-network that contains all perforations, connections, and nodes for a single well, up to the connection to the first gathering node for that well, is referred to as a "tnet". Once a network 100 is divided into one or more tnets, the remaining part of the network (including the first gathering node that the wells join to) is referred to as an "xnet". The xnet receives contributions from multiple tnets, and is used to model interactions between wells. In some embodiments, the network has no xnet (e.g., each well might connect directly to a holding facility).

To simplify the explanation of network simulation herein, a relatively small network 100 of three tnets 114 joined by one xnet 118 is shown. The linearized equation system of the network 100, assuming a fixed reservoir grid 106 condition (i.e., fixed fluid pressure and mobilities at perforated grid blocks 112), can be written as:

$$\begin{pmatrix} A_{t1t1} & A_{t1t2} & A_{t1tN} & A_{t1x} \\ A_{t2t1} & A_{t2t2} & A_{t2tN} & A_{t2x} \\ A_{tNt1} & A_{tNt2} & A_{tNtN} & A_{tNx} \\ A_{xt1} & A_{xt2} & A_{xtN} & A_{xx} \end{pmatrix} \begin{pmatrix} y_{t1} \\ y_{t2} \\ y_{tN} \\ y_x \end{pmatrix} = \begin{pmatrix} r_{t1} \\ t_{t2} \\ r_{tN} \\ r_x \end{pmatrix}, \quad (1)$$

where the subscript t1 represents tnet1, the subscript t2 represents tnet2, the subscript tN represents tnetN, and the subscript x represents the xnet. The variable $y_{t1}$ represents the tnet1 unknowns (e.g., composition and pressure at nodes, total flow rate at connections, and total perforation flow rate at perforations). Similarly, the variable $y_{t2}$ represents the tnet2 unknowns, and the variable $y_{tN}$ represents the tnetN unknowns. The variable $y_x$ represents the xnet unknowns (e.g., composition and pressure at nodes, and total flow rate at connections—there is no perforation flow rate, since the xnet does not represent a well). The variables $r_{t1}$, $r_{t2}$, $r_{tN}$, $r_x$ are residuals of the equations of tnet1, tnet2, tnetN and the xnet, respectively.

The unknowns of the xnet have been placed last to reduce the number of infill terms generated when the matrix is factorized. Since the network 100 has been divided into multiple sub-networks, the Jacobian matrix is written in the form of multiple sub-matrices. For example, sub-matrices $A_{t1t1}$, $A_{t1t2}$, $A_{t1tN}$, and $A_{t1x}$ contain the network equation coefficients of tnet1 that multiply network unknowns of the sub-networks tnet1, tnet2, tnetN, and xnet, respectively; the other sub-matrices are similar, as will be understood by those of ordinary skill in the art, upon studying the content of this disclosure. In the instant example, sub-matrices $A_{t1t2}$ and $A_{t2t1}$ would be empty if there was no cross-connection between tnet1 and tnet2; sub-matrices $A_{t1tN}$ and $A_{tNt1}$ would be empty if there was no cross-connection between tnet1 and tnetN.

However, it is fairly common that there are cross-connections between tnets, as shown in the figure. Such cross-connections are referred to as a "cnet" 120. These cross-connections are of two types: physical and logical.

Physical cnet cross-connections in the network 100 represent physical network devices, such as pipes, which connect tnets. Other examples include connections to re-inject part of the produced fluid into an injection well, or the connections to re-inject part of the produced gas into production well tubing for gaslift. In essence, a physical cnet cross-connection represents any physical device that communicates flow from one tnet to another.

Logical cnet cross-connections in the network 100 represent a logical relationship between tnets. An example might be a maximum total oil phase rate constraint on a group of wells. Thus, even though there is no physical connection between them, the activity in a first well might affect the activity in a second well. The logical connection represents the degree of this indirect effect.

It should be noted that both cnets and xnets connect multiple tnets. Therefore, in most embodiments, cnets are treated as part of the xnet when the equation system for the network 100 is set up.

Active network constraints can be determined using the slack variable method during the solution of the network equation system; in this case, slack variables are additional unknowns of the network equation system which are associated with the same number of constraint equations. These constraint equations can be put at the end of the network equations of the corresponding tnet and xnet, and the slack variable unknowns can be put at the end of the network unknowns of each corresponding tnet and xnet. These procedures, as they are used in conventional applications, are documented in References [3], [4], noted above, and are known to those of ordinary skill in the art.

The solution of the reservoir grid and network coupled system can be obtained using Newton iterations, where the network with a fixed reservoir grid condition (fluid pressure and mobilities at perforated grid blocks) is solved at the beginning of each iteration, or time step. This process is referred to herein as the "standalone network solution process". Once the standalone network solution process is completed for a series of Newton iterations, the reservoir grid and network are combined for global solution, as an overall equation system, also using a series of Newton iterations in a "global solution process". The complete procedure is discussed in detail in conjunction with FIG. 5, and is described generally in the following paragraphs.

To begin, the linearized global system equations of the reservoir grid and network can be written as shown in equation (2):

$$\begin{pmatrix} A_{nn} & A_{nr} \\ A_{rn} & A_{rr} \end{pmatrix}\begin{pmatrix} y_n \\ y_r \end{pmatrix} = \begin{pmatrix} r_n \\ r_r \end{pmatrix}, \tag{2}$$

where $A_{nn}$ and $A_{nr}$ contain the network equation coefficients that multiply network unknowns and reservoir grid unknowns, respectively. $A_{rn}$ and $A_{rr}$ contain the reservoir grid equation coefficients that multiply network unknowns and reservoir grid unknowns, respectively. Thus, $A_{nn}$ actually contains the entire Jacobian matrix of equation (1). $y_n$ and $y_r$ are the network unknowns and reservoir grid unknowns, respectively. $r_n$ and $r_r$ are the residuals of network equations and reservoir grid equations, respectively. The details of solving this type of global system in a conventional manner are known to those of ordinary skill in the art, and others can read about the processes involved by turning to Reference [1], noted above.

Both the standalone network solution process and the global solution process involve construction and factoring a Jacobian matrix of the network equations, i.e., the entire Jacobian matrix of equation (1), and the matrix $A_{nn}$ in equation (2). That is, parallelizing network computations applies to both the standalone network solution process and the reservoir-network global solution process. Thus, the method of parallelizing computations described below applies to each process, and is scalable to a much greater degree than conventional methods.

It should be noted that as parallel computations are performed, message passing can be performed between parallel processes using any standard parallel message passing package, such as MPI (the Message Passing Interface, a standard for message passing that includes a library of message passing functions). This standard includes MPI Version 2.2, released by the Message Passing Interface Forum on Sep. 4, 2009.

Prior to the start of parallel computation, tnets and xnets are assigned to different processors. For example, referring to FIG. 1, if there are three processors (P1, P2, P3) available, tnet1 can be assigned to processor 1 (P1), tnet2 can be assigned to processor 2 (P2), and tnetN and the xnet (including the cnet) can be assigned to processor 3 (P3). In other words, the unknowns of each sub-network can be assigned to different processors.

To begin a Newton parallel processing iteration (or time step) as part of the standalone network solution process, hydraulic pressure drop computations and IPR (Inflow Performance Relationship) computations are performed for each tnet, in parallel. These computations are based on the values of the previous Newton iteration, and are used to construct the Jacobian matrix of the network equation system used in the current Newton iteration.

When correlations are used for the hydraulic pressure drop computations, a number of flash computations may be performed, which is computationally expensive. By performing these computations for each tnet in parallel, the CPU time of individual processors, and the elapsed time needed to complete the computations, is reduced. After all these computations are done for each tnet, the same computations can proceed for the xnet on one or all processors.

To continue with the Newton parallel processing iteration as part of the standalone network solution process, the network Jacobian matrix is constructed in a distributed manner. That is, each processor only needs to determine the coefficients of the unknowns local to that particular processor.

Using the network 100 in FIG. 1 as an example, the unknowns $y_{t1}$ can be assigned to processor P1, the unknowns $y_{t2}$ can be assigned to processor P2, and the unknowns $y_{tN}$ and $y_x$ can be assigned to processor P3. Then, in equation (1), sub-matrices $A_{t1t1}$, $A_{t2t1}$, $A_{tNt1}$, and $A_{xt1}$ are constructed solely by processor P1, sub-matrices $A_{t1t2}$, $A_{t2t2}$, $A_{tNt2}$ and $A_{xt2}$ are constructed solely by processor P2, and sub-matrices $A_{t1x}$, $A_{t2x}$, $A_{tNx}$ and $A_{xx}$ are constructed solely by processor P3. Parallel message passing is used to communicate the data at the boundary connections/nodes between a tnet and another tnet, or between a tnet and an xnet (if such inter-connections exist). These data are used to construct sub-matrices $A_{t1t2}$, $A_{t1tN}$, $A_{t1x}$, $A_{t2t1}$, $A_{t2tN}$, $A_{t2x}$, $A_{tNt1}$, $A_{tNt2}$, $A_{tNx}$, $A_{xt1}$, $A_{xt2}$, and $A_{xtN}$.

To continue with the Newton parallel processing iteration as part of the standalone network solution process, a partial factorization in parallel can be performed using a parallel linear solver, which will return the resulting Schur complement matrix to the host processor (e.g., the processor with a rank of zero in the MPI communicator, which can be any processor among the processors P1, P2, and P3). Partial factorization operates to eliminate network unknowns, including the pressures and fluid compositions at nodes, and total fluid flow rates at connections and perforations. The resulting Schur complement matrix is used to solve for Schur variables, which are slack variables, in the host processor (e.g., the processor with a rank of zero in the MPI communicator). Then, the solver can be used to back-solve for the network unknowns in parallel.

To complete the Newton parallel processing iteration, the network unknowns are updated using the solution of the current Newton iteration. The parallel processing Newton iteration (as part of the standalone network solution process) is incremented and repeated until convergence is determined.

A generic version of a global solution process of reservoir and network integrated system is documented in Reference [1], noted above. This process involves the construction and factoring of the Jacobian matrix of the network equation, i.e., the Jacobian matrix in equation (1) or $A_{nn}$ in equation (2), and the general solution of network unknowns, at each global Newton iteration. The parallelization method described herein is also applied to this global solution process, i.e., the network Jacobian matrix is constructed in a distributed manner, then a partial factorization in parallel can be performed using a parallel linear solver, which will return the resulting Schur complement matrix to the host processor (e.g., the processor with a rank of zero in the MPI communicator). The resulting Schur complement matrix is used to solve for Schur variables, which are slack variables, in the host processor. Then, the parallel linear solver can be used to back-solve for the network unknowns in parallel.

In this way, the parallelization of network computations can reduce the elapsed time and the CPU time of individual processor when compared to traditional sequential computation. This is because, first, the hydraulic pressure drop computations and IPR computations for all tnets connections will be performed in parallel on different processors, instead of sequentially on one or all processors. Calculation time is reduced, especially when there are a large number of wells, when the number of connections is large, and/or when computationally-expensive flash calculations are used to determine fluid phase behavior in the network. Second, the factorization of network Jacobian matrix and the solution of network unknowns are now performed in parallel. Various embodiments that include some or all of these features will now be described in detail.

Figure 2:
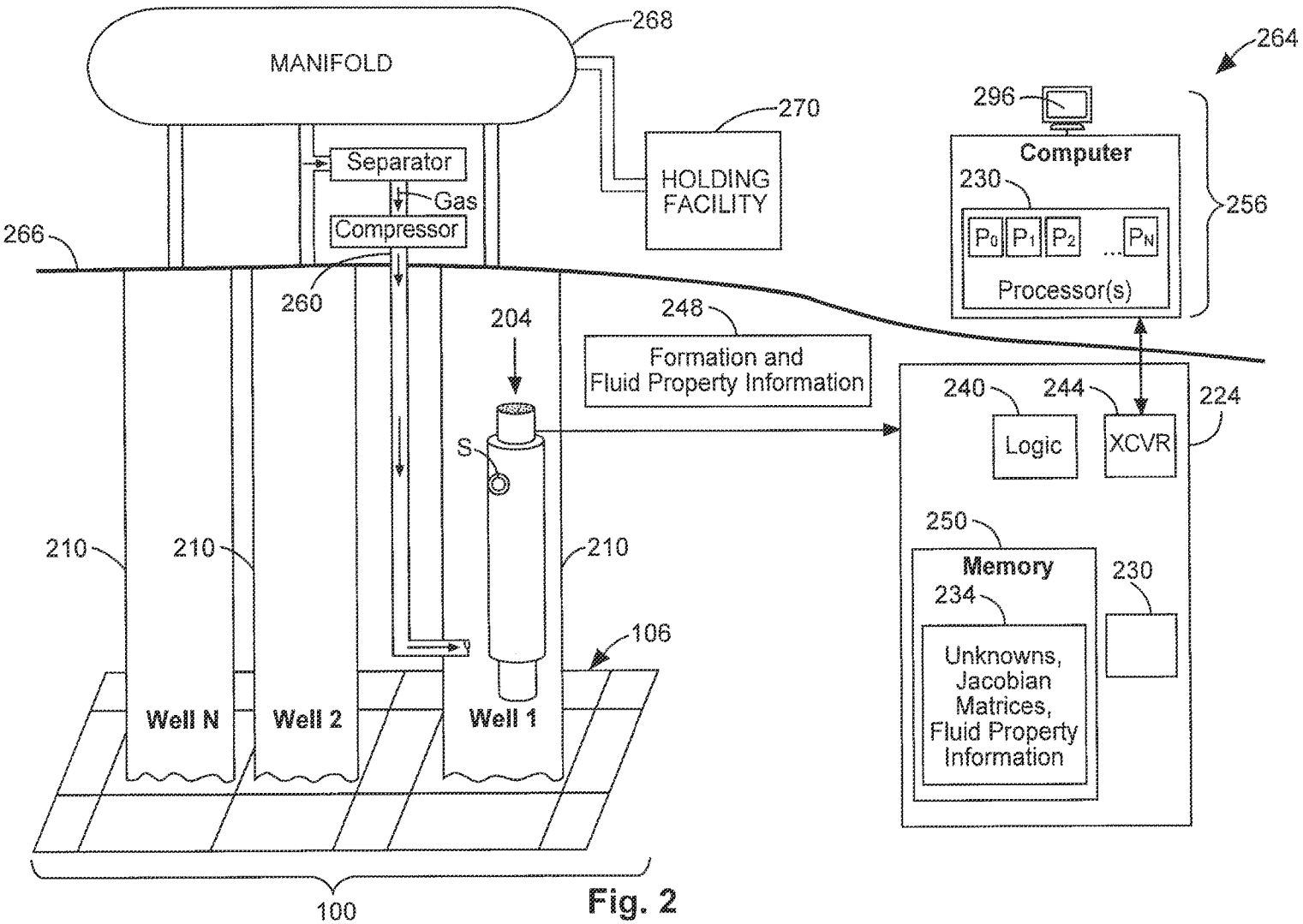
FIG. 2 is a block diagram of a system embodiment of the invention as a system.

FIG. 2 is a block diagram of a system embodiment of the invention. As seen in the figure, in some embodiments, a system 264 includes a housing 204. The housing 204 might take the form of a wireline tool body or a down hole tool, such as a logging while drilling tool or a measurement while drilling tool, among others. Processors 230 ($P_0$, $P_1$, $P_2$, $P_3$, . . . $P_N$) within the system 264 may be located at the surface 266, as part of a surface logging facility 256, or in a data acquisition system 224, which may be above or below the Earth's surface 266 (e.g., attached to the housing 204). Thus, processing during various activities conducted by the system 264 may be conducted both down hole and at the surface 266. In this case, the processors 230 may comprise multiple computational units, some located down hole, and some at the surface 266.

A system 264 may further comprise a data transceiver 244 (e.g., a telemetry transmitter and/or receiver) to transmit acquired data 248 (e.g., formation and fluid property information, perhaps including fluid phase behavior) from sensors S to the surface logging facility 256. Logic 240 can be used to acquire the data as signals, according to the various methods described herein. Acquired data 248, as well as other data, can be stored in the memory 250, perhaps as part of a database 234. Formation and fluid property information, equation unknowns, the content of Jacobian matrices, residues, and other values may be stored in the memory 250.

Thus, referring now to FIGS. 1-2, it can be seen that many embodiments may be realized, including a system 264 that comprises a housing 204 and one or more processors 230, which may be located down hole or at the surface 266. For example, in some embodiments a system 264 comprises a down hole housing 204 that acquires data 248 (e.g., formation and fluid property information, perhaps including fluid phase behavior) in real time, which feeds into the parallel processing algorithm described above so that the dynamic behavior of the network 100, including the reservoir grid 106, the wells Well1, Well2, . . . , WellN, sinks (e.g., the manifold 268 and the holding facility 270), and cross-connects (e.g., gas lift injection 260) can be observed in real time. In some embodiments, the parallel processing algorithm runs on a parallel processing computer (e.g., workstation 256) that is located in a lab or an office. In others, the processors 230 are housed down hole. In some embodiments, the processing is split between processors 230 at the surface, and processors 230 down hole, using real time data 248 acquired via down hole sensors S. High-speed telemetry may be used to communicate information between processors.

The data stored in the memory 250 may include any number of parameters, including seismic interpolation data, earth modeling data, fluid and rock properties, surface facility configurations, and production history, among others. The results of reservoir simulation can be used for field development planning and optimization.

In some embodiments, a system 264 comprises a housing 204 having sensors S to be operated in a first well Well1. The system 264 may also comprise a number of processors 230 communicatively coupled to the housing 204.

The processors 230 may operate to receive data 248 (e.g., formation and fluid property information) from the sensors S, and to compute, in parallel, to determine values of unknowns in network equations associated with a network 100 of sub-surface wells Well1, Well2, . . . , WellN, and at least one surface facility (e.g., the holding facility 270), for intra-well (tnet) subdivisions of the network, and then for inter-well (xnet) subdivisions of the network 100.

The network equations comprise connection equations, perforation equations, and mass balance equations. The act of computing is based on default values of the unknowns, or prior determined values of the unknowns, along with the formation and fluid property information.

The processors 230 may operate to construct a distributed Jacobian matrix having portions comprising coefficients of the unknowns distributed among the number of processors 230, wherein each of the portions is distributed to a particular one of the processors previously assigned to corresponding ones of the subdivisions. The processors 230 may operate to at least partially factor, in parallel, the Jacobian matrix to provide factors and eliminate some of the unknowns, including at least one of pressures at nodes, fluid compositions at nodes, or flow rates at connections. The processors 230 may also operate to back-solve, in parallel, for any remaining unsolved ones of the unknowns, using the factors.

The data 248 acquired from the sensors S can be selected to achieve specific goals, such as providing information that can be used to improve production output. For example, measurements of pressure and flow rates might be useful to tune the input to the simulation, so that predictions provided by the simulation (e.g., for the next hour, day, or some other selected time period that might be useful to control well operations) are as close to actual past behavior as possible.

To this end, in some embodiments, an automated history matching process is implemented to tune the simulator input so that simulator output predictions more closely match actual behavior during a selected prior time period, such as the past day or week. In this way, the predictions for the next day, week, etc. should be more reliable.

Simulator inputs amenable to tuning include reservoir (grid block) parameters, such as permeability, rock compressibility, and relative permeability; well completion properties, such as the skin factor; pipe properties, including roughness, or a choice of pressure drop correlation (e.g., Hagedorn versus Beggs & Brill); fluid properties (e.g., equation of state parameters or black oil tables); and many more. Prediction outputs that might be used to improve production output include choke and valve settings, well workovers (e.g., plugging or opening perforations), scheduling the drilling of wells, reconfiguring the surface network (e.g., adding or removing pipes, rerouting pipes to avoid bottlenecks, adding or removing separators, and rerouting or reconfiguring separators to maximize oil production) and so on.

In this way, downhole and surface information can be used as simulator input, to adjust and enhance simulator operation, and/or field operations, ultimately providing a simulation output that can be used to adjust valves, chokes, etc. in a manual or automated fashion). Thus, in some embodiments, the data 248 that is acquired (e.g., formation and/or fluid property information) can be selected to provide output values of the unknowns associated with physical device operations (e.g., operations of chokes, valves, separators, etc.) forming part of the network and/or one or more surface facilities. In some embodiments, one or more of the formation information, fluid property information, flow rate information, or pressure information is selected to provide input values that are used to calibrate the network and reservoir equations. In some embodiments, the values of the unknowns determined by the network and reservoir equations are used to automatically adjust the operation of physical devices.

Telemetry can be used to send the data (e.g., formation and fluid property information) to the surface for processing in a parallel processing workstation. Thus, in some embodiments, a transceiver 244 (e.g., including a telemetry transmitter) attached to the housing 204 can be used to communicate the acquired data 248 to a surface data processing facility 256.

Wireline or down hole (e.g., drilling) tools can be used as a specific form of the housing. Thus, in some embodiments, the housing 204 may comprise one of a wireline tool or a down hole tool. Additional embodiments may be realized, and thus, some additional examples of systems will now be described.

Figure 3:
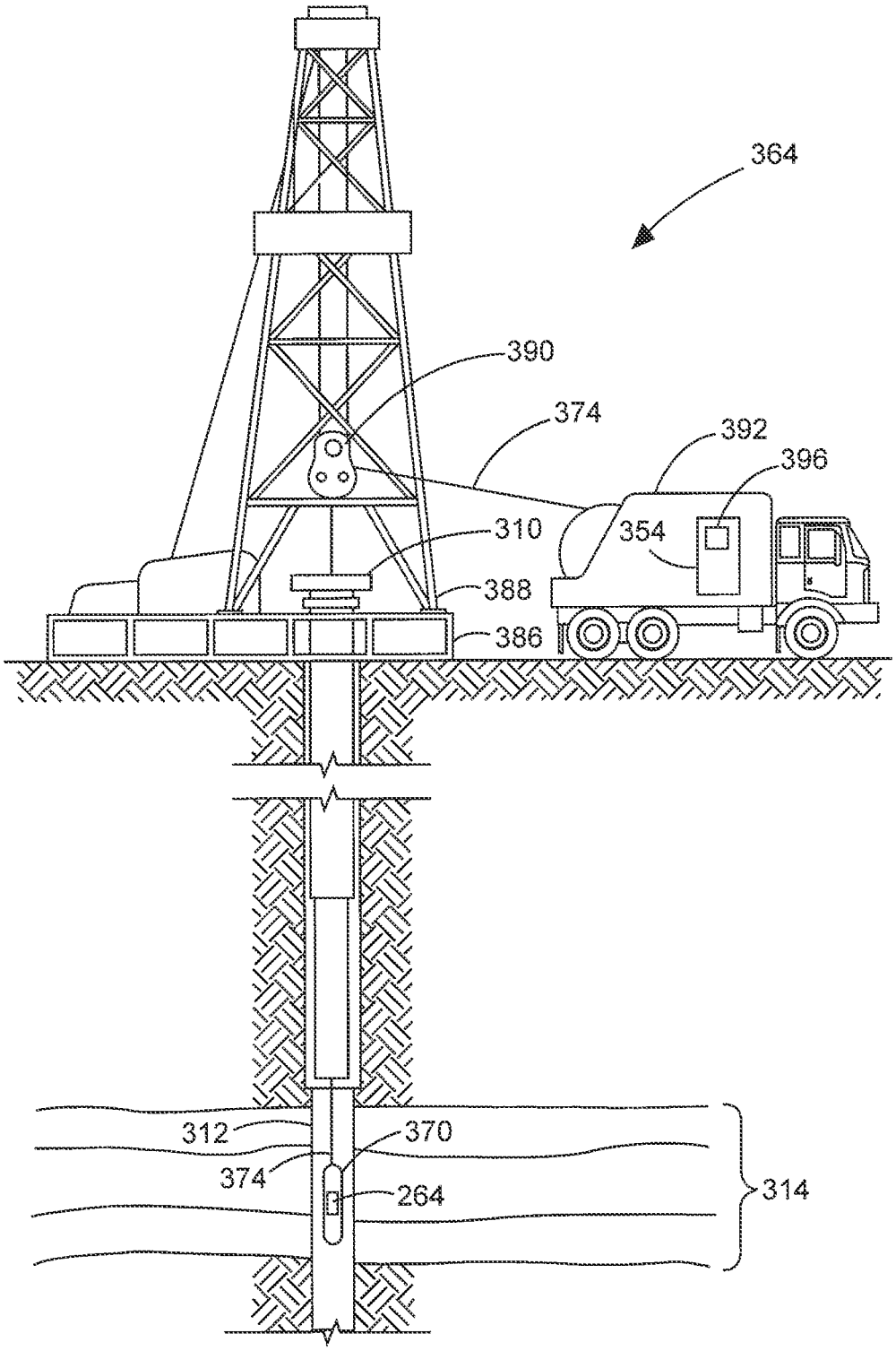
FIG. 3 illustrates a wireline system embodiment of the invention.
Figure 4:
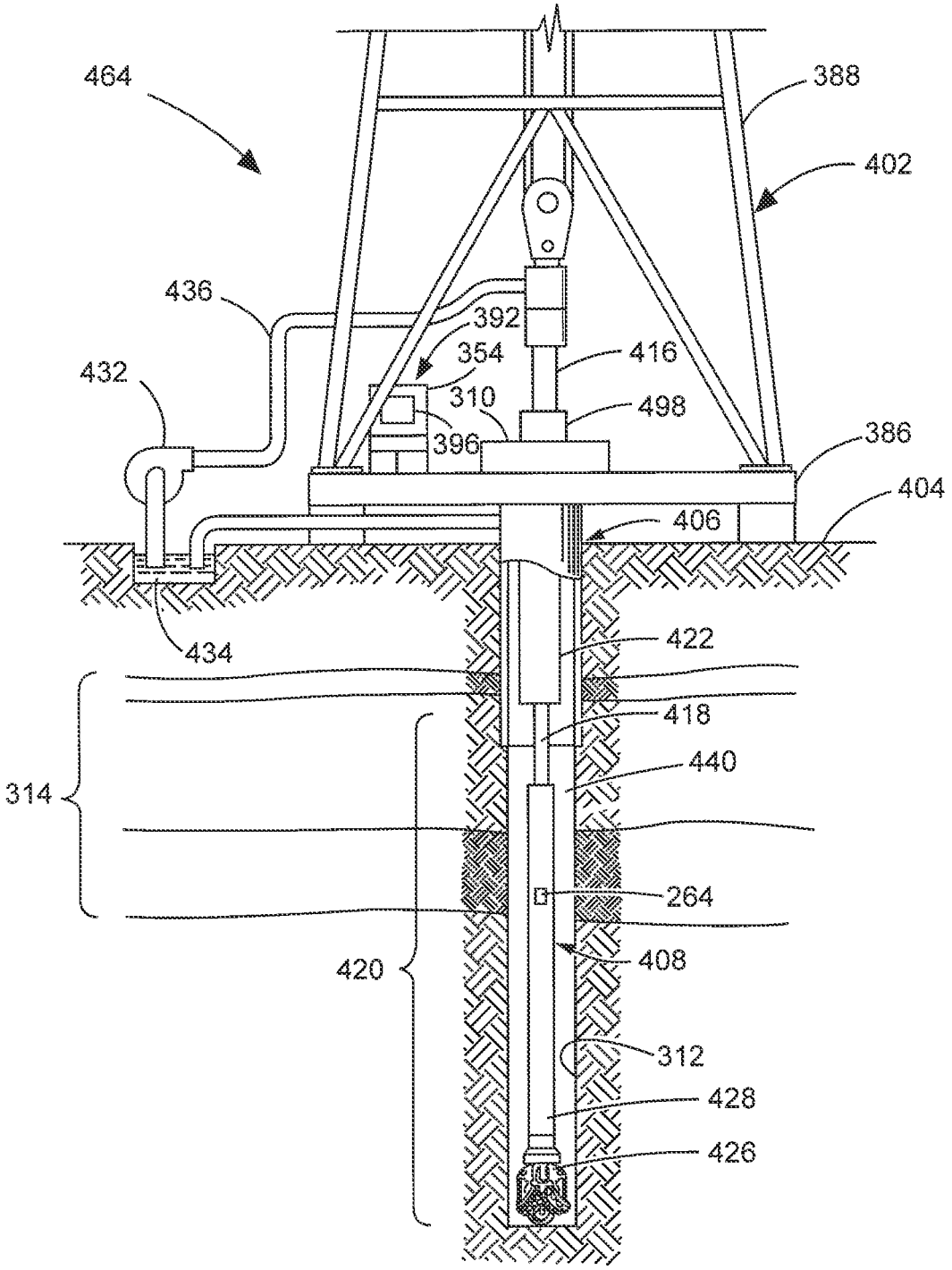
FIG. 4 illustrates a drilling rig system embodiment of the invention.

FIG. 3 illustrates a wireline system 364 embodiment of the invention, and FIG. 4 illustrates a drilling rig system 464 embodiment of the invention. Therefore, the systems 364, 464 may comprise portions of a wireline logging tool body 370 as part of a wireline logging operation, or of a down hole tool 428 as part of a down hole drilling operation. The systems 364 and 464 may comprise any one or more elements of the system 264 shown in FIG. 2.

Thus, FIG. 3 shows a well during wireline logging operations. In this case, a drilling platform 386 is equipped with a derrick 388 that supports a hoist 390.

Drilling oil and gas wells is commonly carried out using a string of drill pipes connected together so as to form a drilling string that is lowered through a rotary table 310 into a wellbore or borehole 312. Here it is assumed that the drilling string has been temporarily removed from the borehole 312 to allow a wireline logging tool body 370, such as a probe or sonde, to be lowered by wireline or logging cable 374 into the borehole 312. Typically, the wireline logging tool body 370 is lowered to the bottom of the region of interest and subsequently pulled upward at a substantially constant speed.

During the upward trip, at a series of depths, various instruments included in the tool body 370 may be used to perform measurements (e.g., made by portions of the system 264 shown in FIG. 2) on the subsurface geological formations 314 adjacent the borehole 312 (and the tool body 370). The borehole 312 may represent one or more offset wells, or a target well.

The measurement data (e.g., formation and fluid property information) can be communicated to a surface logging facility 392 for processing, analysis, and/or storage. The logging facility 392 may be provided with electronic equipment for various types of signal processing, which may be implemented by any one or more of the components of the system 264 in FIG. 2. Similar formation evaluation data may be gathered and analyzed during drilling operations (e.g., during logging while drilling operations, and by extension, sampling while drilling).

In some embodiments, the tool body 370 is suspended in the wellbore by a wireline cable 374 that connects the tool to a surface control unit (e.g., comprising a workstation 354). The tool may be deployed in the borehole 312 on coiled tubing, jointed drill pipe, hard wired drill pipe, or any other suitable deployment technique.

Turning now to FIG. 4, it can be seen how a system 464 may also form a portion of a drilling rig 402 located at the surface 404 of a well 406. The drilling rig 402 may provide support for a drill string 408. The drill string 408 may operate to penetrate the rotary table 310 for drilling the borehole 312 through the subsurface formations 314. The drill string 408 may include a Kelly 416, drill pipe 418, and a bottom hole assembly 420, perhaps located at the lower portion of the drill pipe 418.

The bottom hole assembly 420 may include drill collars 422, a down hole tool 424, and a drill bit 426. The drill bit 426 may operate to create the borehole 312 by penetrating the surface 404 and the subsurface formations 314. The down hole tool 424 may comprise any of a number of different types of tools including measurement while drilling tools, logging while drilling tools, and others.

During drilling operations, the drill string 408 (perhaps including the Kelly 416, the drill pipe 418, and the bottom hole assembly 420) may be rotated by the rotary table 310. Although not shown, in addition to, or alternatively, the bottom hole assembly 420 may also be rotated by a motor (e.g., a mud motor) that is located down hole. The drill collars 422 may be used to add weight to the drill bit 426. The drill collars 422 may also operate to stiffen the bottom hole assembly 420, allowing the bottom hole assembly 420 to transfer the added weight to the drill bit 426, and in turn, to assist the drill bit 426 in penetrating the surface 404 and subsurface formations 314.

During drilling operations, a mud pump 432 may pump drilling fluid (sometimes known by those of ordinary skill in the art as "drilling mud") from a mud pit 434 through a hose 436 into the drill pipe 418 and down to the drill bit 426. The drilling fluid can flow out from the drill bit 426 and be returned to the surface 404 through an annular area between the drill pipe 418 and the sides of the borehole 312. The drilling fluid may then be returned to the mud pit 434, where such fluid is filtered. In some embodiments, the drilling fluid can be used to cool the drill bit 426, as well as to provide lubrication for the drill bit 426 during drilling operations. Additionally, the drilling fluid may be used to remove subsurface formation cuttings created by operating the drill bit 426.

Thus, referring now to FIGS. 2-4, it may be seen that in some embodiments, the systems 364, 464 may include a drill collar 422, a down hole tool 424, and/or a wireline logging tool body 370 to house one or more systems 264, or portions of those systems 264, described above and illustrated in FIG. 2.

Thus, for the purposes of this document, the term "housing" may include any one or more of a drill collar 422, a down hole tool 424, or a wireline logging tool body 370 (all having an outer surface, to enclose or attach to sensors, magnetometers, fluid sampling devices, pressure measurement devices, temperature measurement devices, transmitters, receivers, acquisition and processing logic, and data acquisition systems). The tool 424 may comprise a down hole tool, such as an LWD tool or MWD tool. The wireline tool body 370 may comprise a wireline logging tool, including a probe or sonde, for example, coupled to a logging cable 374. Many embodiments may thus be realized.

For example, in some embodiments, a system 364, 464 may include a display 396 to present simulator behavior, as well as database information (e.g., measured values of formation and fluid property information), perhaps in graphic form.

The network 100; reservoir grid 106; sub-grids 110; grid blocks 112; intra-well network subdivisions (tnet1, tnet2, . . . , tnetN) 114; inter-well network subdivisions (xnets) 118; cross-connections (cnets) 120; connections 124; perforations 128; tubing heads 132; gathering centers 136; distribution centers 140; housing 204; wells (Well1, Well2, . . . , WellN) 210; processors ($P_0$, $P_1$, $P_2$, $P_3$, . . . $P_N$) 230; database 234; logic 240; transceiver 244; acquired data 248; memory 250; surface logging facility 256; fracture 260; systems 264, 364, 464; surface 266; manifold 268; holding facility 270; computer workstation 354; wireline logging tool body 370; logging cable 374; drilling platform 386; derrick 388; hoist 390; logging facility 392; display 396; drill string 408; Kelly 416; drill pipe 418; bottom hole assembly 420; drill collars 422; down hole tool 424; drill bit 426; mud pump 432; mud pit 434; hose 436; cnets, tnets, xnets, and sensors S may all be characterized as "modules" herein.

Such modules may include hardware circuitry, and/or a processor and/or memory circuits, software program modules and objects, and/or firmware, and combinations thereof, as desired by the architect of the systems 264, 364, 464 and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of systems 264, 364, 464 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 5:
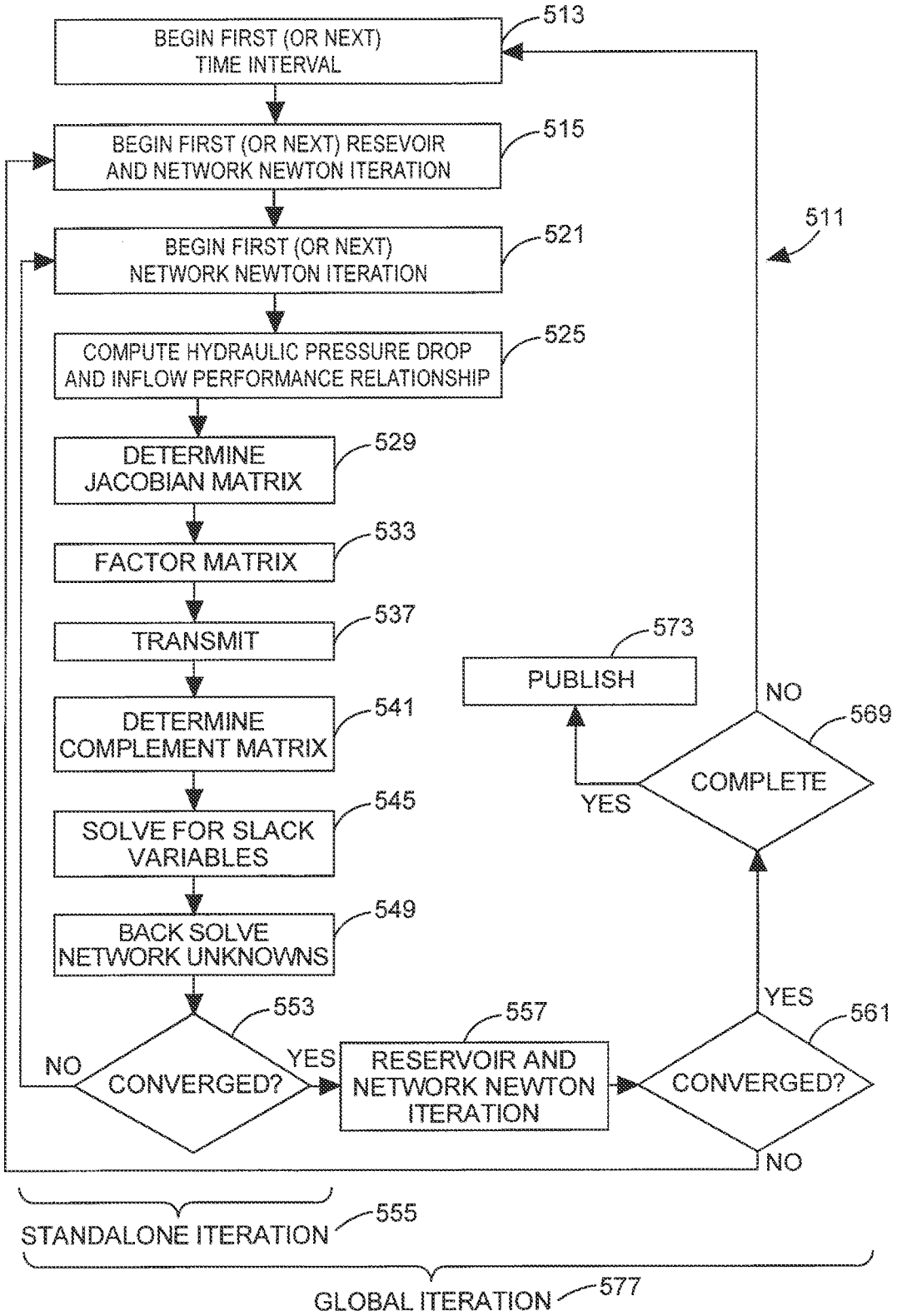
FIG. 5 is a flow chart illustrating several methods according to various embodiments of the invention.

For example, FIG. 5 is a flow chart illustrating several methods 511 according to various embodiments of the invention. The methods 511 may comprise processor-implemented methods, to execute on one or more processors that perform the methods, in parallel.

As noted previously, a network of wells and surface facilities (e.g., a pipeline network) can be represented by a linearized system of network equations. The coefficients of these equations can be determined by dividing the network into intra-well (tnet) subdivisions, and inter-well (xnet) subdivisions. Each processor is assigned to one or more of the subdivisions (tnets and/or xnets), and is used to solve, in parallel, for the unknowns associated with their assigned subdivisions.

Thus, the basic method 511 may include parallel processing to compute hydraulic pressure drop and IPR (Inflow Performance Relationship) s at every connection (as a function of at least one of the unknowns associated with some of the sub-surface wells), construct a single Jacobian matrix, factor the matrix, and back-solve for any remaining unsolved unknowns, in a series of Newton iterations. This standalone network solution process is embedded in an over-arching global solution process, also comprising a number of Newton iterations.

Therefore, one embodiment of the methods 511 may begin at blocks 513, 515, and 521 with the first Newton iteration of the standalone network solution process, over a given time interval. The method 511 may continue on to block 525 with computing, in parallel, hydraulic pressure drop and inflow performance relationships associated with a network of sub-surface wells and at least one surface facility, for intra-well subdivisions of the network, and then for inter-well subdivisions of the network, based on the values of the previous Newton iteration; these computations are necessary to construct the Jacobian matrix of the network equations, wherein the network equations comprise connection equations, perforation equations, and mass balance equations, and wherein the computing is based on default values of the unknowns, or prior determined values of the unknowns.

The physical network of wells and surface facilities may be divided into parts (e.g., intra-well subdivisions and inter-well subdivisions) that make up a tree-structure. Thus, in some embodiments, the subdivisions are coupled together, using physical and logical connections, according to a tree structure.

The network equations may comprise a variety of equations that describe the network operations, including hydraulic pressure drop equations (a type of connection equation) or an inflow performance relationship (a type of perforation equation). Thus, in some embodiments, the network equations comprise equations used to determine at least one of a hydraulic pressure drop or an inflow performance relationship for some of the sub-surface wells.

Cross-connections between the intra-well subdivisions, including physical cross-connections or logical cross-connections, can be included in the inter-well subdivisions. A cnet has the same types of network equations as an xnet. In equation (1) for example, the equations and unknowns for the xnet include the equations and unknowns of the cnet.

The cnet can also contain auxiliary variables, such as a facility constraint, or a reinjection composition. For example, a facility constraint might require that the sum of water rates from the producing wells be less than the amount of water capacity of the facility. The constraint may be satisfied by reducing the water rate of the well producing the highest fraction of water (e.g., the highest water cut), which might be known as the "swing well". An auxiliary variable t can be introduced, which is equal to the facility water capacity: the sum of the water production rates of all wells associated with the facility, except the swing well. This variable t would then form a part of the xnet. The water rate constraint equation for the swing well depends only on the xnet variable t, and variables that belong to its own tnet (e.g., composition, node pressure and total flow rate), which ensures that the sub-matrices connecting tnets in equation (1) remain empty. Thus, inter-well subdivisions may comprise cross-connections (cnets) between the intra-well subdivisions.

The method 511 may continue on to block 529 with constructing a distributed Jacobian matrix having portions comprising coefficients of the unknowns distributed among the number of processors, wherein each of the portions is distributed to a particular one of the processors previously assigned to corresponding ones of the subdivisions.

An MPI library can be accessed to communicate data from one boundary connection/node in a first subdivision, to another boundary connection/node in another subdivision. For example, from one tnet to another, or from one tnet to an xnet. Thus, the activity at block 529 may comprise accessing an MPI library during the construction of the Jacobian matrix, to communicate data between the subdivisions/processors.

The method 511 may continue on to block 533 to include at least partially factoring, in parallel, the Jacobian matrix to provide factors and eliminate some of the unknowns including at least one of pressures at nodes, fluid compositions at nodes, or flow rates at connections.

A parallel linear solver can be used to factor the Jacobian matrix. Thus, the activity at block 533 may comprise using a parallel linear solver to accomplish the factoring.

The MPI library can be used to define a host processor, which can be designated to receive complement matrix (e.g., Schur matrix) values that result from the factoring. Thus, the method 511 may continue on to block 537 to include, after the factoring, transmitting the complement matrix to a single processor included in the number of processors.

Slack variables comprise additional unknowns having a one-to-one correspondence with the same number of network constraint equations. These variables can be determined as part of the solution process. Thus, the method 511 may continue on to block 545 with solving for unknowns as slack variables associated with the complement matrix using the single processor. The determined values of slack variables may be associated with a matrix comprising the factors (produced by the factoring activity in block 533).

The complement matrix may comprise a Schur matrix. Thus, the activity of determining variables at block 545 may comprise solving for the unknowns as slack variables associated with a Schur complement matrix on one of the number of processors. That is, the complement matrix values can be used by the host processor to determine Schur variables as slack variables.

The method 511 may continue on to block 549 with back-solving, in parallel, for any remaining unsolved ones of the network unknowns, using the factors produced by the factoring activity in block 533. A parallel linear solver can be used to back-solve for the unsolved unknowns. Thus, the activity at block 549 may comprise using a parallel linear solver to accomplish the back-solving.

The slack variables can be used to help back-solve for remaining unsolved unknowns, improving the solution efficiency. Thus, the activity at block 549 may comprise back-solving, in parallel, for any remaining unsolved ones of the network unknowns, using the factors and the determined values of the slack variables.

Each of the activities in the portion of the method 511 that is used to determine the standalone network solution (blocks 521-549) can be repeated as a series of Newton solution iterations, to converge to a solution of the values of the unknowns. Thus, the method 511 may continue on to block 553, with a test for convergence.

If convergence to some desired degree has not been reached, as determined at block 553, then the method 511 may return to block 521 to execute another network Newton iteration. Thus, the method 511 may comprise repeating the computing, the constructing, the factoring, and the back-solving as a series of Newton solution iterations (the standalone iterations 555) to refine the values of the unknowns until residuals associated with the unknowns have been reduced below a first selected threshold value, as determined at block 553.

Once standalone network solution convergence is achieved, convergence for the reservoir and network solution can be tested. Thus, if standalone convergence is reached, as determined at block 553 (e.g., the residuals associated with the unknowns in the network equations (e.g., equation (1)) have been reduced below a first selected threshold value), then the method 511 may continue on to block 557. At this point, the method 511 may continue on to block 561 with repeatedly testing (at blocks 561-569) for convergence in a global set of equations (e.g., equation (2), and the global iterations 577) that describe the behavior of a reservoir associated with the network equations, to refine the values of unknowns in the global set of equations until residuals associated with the unknowns in the global set of equations have been reduced below a second selected threshold value, as determined at block 561. Until convergence is reached, as determined at block 561, the method 511 may return to block 515 to begin the next reservoir and network Newton iteration.

The unknowns that have been determined can be published (e.g., shown on a display, printed on paper, or stored in a non-transitory memory). Thus, after the global solution is complete, the method 511 may continue on to block 573 with publishing the values of at least some of the unknowns, perhaps in graphical form on a display.

To summarize, once a suitable solution to the standalone network equations is found, using a first series of Newton iterations 555, the solution to the overall system can be found, using a second series of Newton iterations 577 (the first series being embedded in each of the iterations of the second series), over a give time interval (signified by block 513). Thus, the method 511 may comprise repeating the computing, the constructing, the factoring, and the back-solving as a first series of Newton solution iterations 555; and solving a global set of equations describing a reservoir associated with the network equations as a second series of Newton solution iterations 577, in which each one of the second series of Newton solution iterations contains at least one of the first series of Newton solution iterations.

It should be noted that the methods described herein do not have to be executed in the order described, or in any particular order. Moreover, various activities described with respect to the methods identified herein can be executed in iterative, serial, or parallel fashion. The various elements of each method (e.g., the methods shown in FIG. 5) can be substituted, one for another, within and between methods. Information, including parameters, commands, operands, and other data, can be sent and received in the form of one or more carrier waves.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand the various programming languages (e.g., FORTRAN 95) that may be employed to create one or more software programs designed to implement and perform the methods disclosed herein. For example, the programs may be structured in an object-orientated format using an object-oriented language such as Java or C#. In another example, the programs can be structured in a procedure-orientated format using a procedural language, such as assembly or C. The software components may communicate using any of a number of mechanisms well known to those skilled in the art, such as application program interfaces or interprocess communication techniques, including remote procedure calls. The teachings of various embodiments are not limited to any particular programming language or environment. Thus, other embodiments may be realized.

Figure 6:
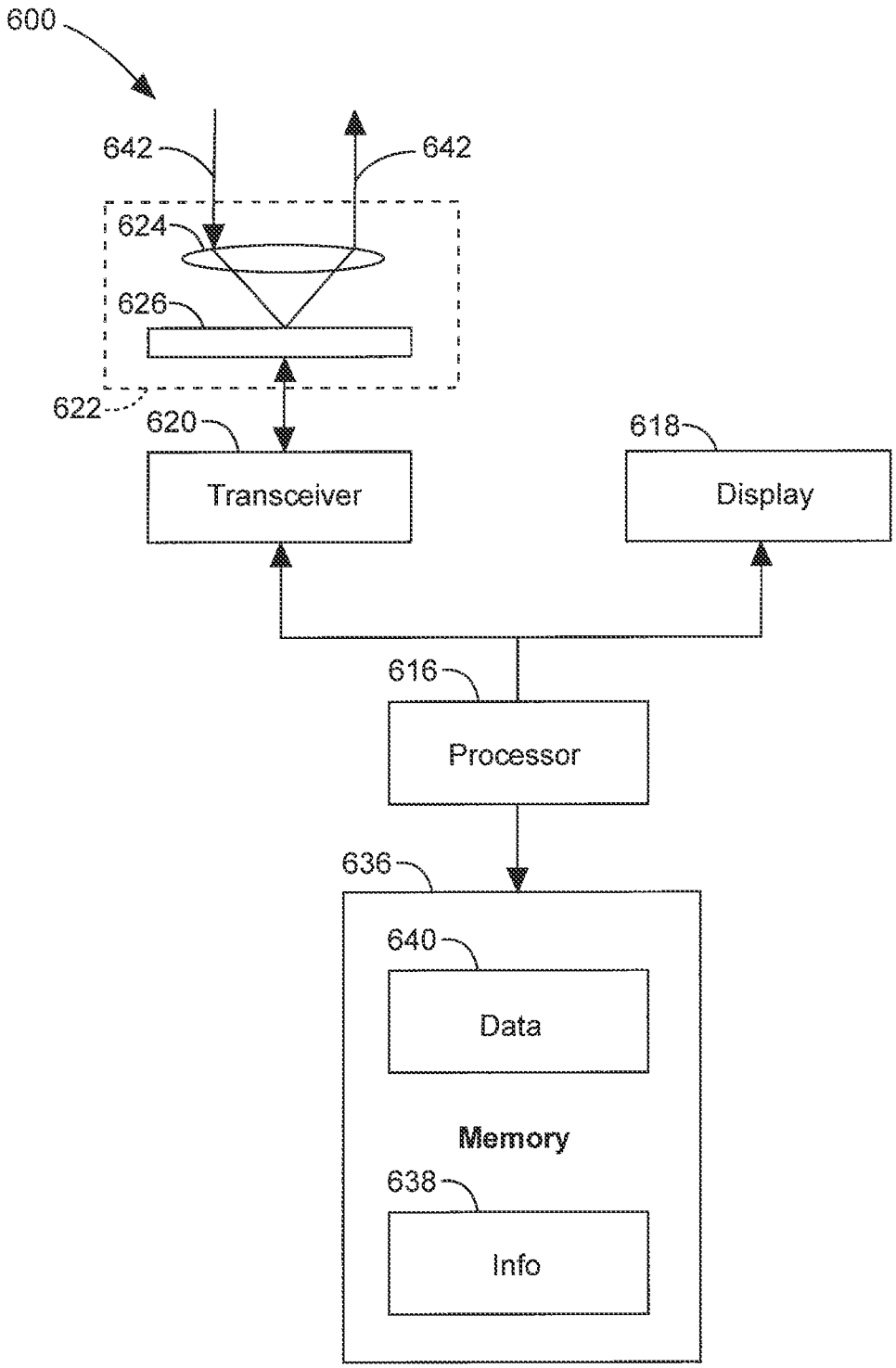
FIG. 6 is a block diagram of an article according to various embodiments of the invention.

For example, FIG. 6 is a block diagram of an article 600 of manufacture according to various embodiments, such as a computer, a memory system, a magnetic or optical disk, or some other storage device. The article 600 may include one or more processors 616 coupled to a machine-accessible medium such as a memory 636 (e.g., removable storage media, as well as any tangible, non-transitory machine-accessible medium (e.g., a memory including an electrical, optical, or electromagnetic conductor) having associated information 638 (e.g., computer program instructions and/or data), which when accessed by one or more of the processors 616, results in a machine (e.g., the article 600) performing any of the actions described with respect to the methods of FIG. 5, and the systems of FIGS. 2-4. The processors 616 may comprise one or more processors sold by Intel Corporation (e.g., Intel® Core™ processor family), Advanced Micro Devices (e.g., AMD Athlon™ processors), and other semiconductor manufacturers.

In some embodiments, the article 600 may comprise one or more processors 616 coupled to a display 618 to display data processed by the processor 616 and/or a wireless transceiver 620 (e.g., a down hole telemetry transceiver) to receive and transmit data processed by the processor.

The memory system(s) included in the article 600 may include memory 636 comprising volatile memory (e.g., dynamic random access memory) and/or non-volatile memory. The memory 636 may be used to store data 640 processed by the processor 616, including corrected compressional wave velocity data that is associated with a first (e.g., target) well, where no measured shear wave velocity data is available.

In various embodiments, the article 600 may comprise communication apparatus 622, which may in turn include amplifiers 626 (e.g., preamplifiers or power amplifiers) and one or more transducers 624 (e.g., transmitting and/or receiving devices, such as acoustic transducers). Signals 642 received or transmitted by the communication apparatus 622 may be processed according to the methods described herein.

Many variations of the article 600 are possible. For example, in various embodiments, the article 600 may comprise a down hole tool, including any one or more elements of the system 264 shown in FIG. 2. Some of the potential advantages of implementing the various embodiments described herein will now be described.

In summary, the apparatus, systems, and methods disclosed herein can use nested Newton iterations, and parallel processing, to scale the solution of network simulations, so that the CPU time of individual processors (and therefore, the elapsed simulation time) is reduced to a significant degree, when compared to conventional mechanisms. The ability to achieve increased processing efficiency in this area can greatly enhance the value of the services provided by an operation/exploration company.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A system for parallel processing multi-well network simulations, comprising:

a housing positioned in a borehole having sensors to be operated in a first well that is included in a network that comprises a plurality of interconnected wells; and a plurality of processors communicatively coupled to the housing, the processors to, receive formation and/or fluid property information from the sensors;

compute, in parallel, to determine values of unknowns in network equations for intra-well subdivisions of the network; and in response to determining values of unknowns in the network equations for the intra-well subdivisions, compute, in parallel, to determine values of unknowns in network equations for inter-well subdivisions of the network, wherein determining the values of the unknowns in network equations for intra-well and inter-well subdivisions includes, constructing a distributed Jacobian matrix having portions comprising coefficients of the unknowns, wherein said constructing includes distributing the portions among at least two of the processors, wherein said distributing includes distributing each of the portions to a particular one of the processors previously assigned to corresponding ones of the subdivisions, wherein a given processor of the plurality of processors associated with an intra-subdivision well only computes the coefficients of the unknowns which are local to the given processor;

at least partially factoring, the Jacobian matrix to provide factors and solve some of the unknowns;

back-solving, for any remaining unsolved ones of the unknowns, using the factors and the determined values; and adjusting operation of devices associated with the plurality of interconnected wells based on the values of unknowns in the network equations for intra-well subdivisions and inter-well subdivisions of the network.

2. The system of claim 1, further comprising:

a telemetry transmitter attached to the housing, the telemetry transmitter to communicate the formation and/or fluid property information to a surface data processing facility.

3. The system of claim 1, wherein the housing comprises one of a wireline tool or a down hole tool.

4. The system of claim 1, wherein at least one of the processors is housed by the housing.

5. The system of claim 1, wherein at least one of the formation and/or fluid property information, flow rate information, or pressure information is used to provide input values which can be used to calibrate the network equations.

6. The system of claim 1, wherein the network equations for at least one of the intra-well subdivisions and the inter-well subdivisions comprise connection equations, perforation equations, and mass balance equations.

7. The system of claim 1, wherein the computing, in parallel, to determine values of unknowns in network equations for intra-well subdivisions and inter-well subdivisions is based on default values of the unknowns or prior determined values of the unknowns, and the formation and/or fluid property information.

8. The system of claim 1, wherein the unknowns associated with the inter-well subdivision are organized to reduce infill terms generated when the Jacobian matrix is factorized.

9. The system of claim 1, wherein the network comprises a first part, a second part, and a common part, wherein the values of unknowns in network equations for an intra-well subdivision of the intra-well subdivision is associated with the first part of the network and the common part and the values of unknowns in network equations for an inter-well subdivision of the inter-well subdivisions is associated with the second part and the common part.

10. A method for parallel processing multi-well network simulations, said method comprising:

a plurality of processors receiving formation and/or fluid property information from downhole sensors, wherein the downhole sensors are positioned in a borehole and operated in a first well that is included in a network that comprises a plurality of interconnected wells;

the processors computing, in parallel, to determine values of unknowns in network equations for intra-well subdivisions of the network; and in response to determining values of unknowns in the network equations for the intra-well subdivisions, compute, in parallel, to determine values of unknowns in network equations for inter-well subdivisions of the network, wherein determining the values of the unknowns in network equations for intra-well and inter-well sub-divisions includes;

constructing a distributed Jacobian matrix having portions comprising coefficients of the unknowns, wherein said constructing includes distributing the portions among at least two of the processors, wherein said distributing includes distributing each of the portions to a particular one of the processors previously assigned to corresponding ones of the subdivisions, wherein a given processor of the plurality of processors associated with an intra-subdivision well only computes the coefficients of the unknowns which are local to the given processor;

at least partially factoring the Jacobian matrix to provide factors and solve some of the unknowns;

back-solving for any remaining unsolved ones of the unknowns, using the factors; and adjusting operation of devices associated with the plurality of interconnected wells based on the values of unknowns in the network equations for intra-well subdivisions and inter-well subdivisions of the network.

11. The method of claim 10, wherein the subdivisions are coupled together, using physical and logical connections, according to a tree structure.

12. The method of claim 10, wherein the network equations comprise equations used to determine at least one of a hydraulic pressure drop or an inflow performance relationship as a function of at least one of the unknowns associated with some of the wells within the network.

13. The method of claim 10, further comprising:

determining values of slack variables as determined values associated with a matrix comprising the factors.

14. The method of claim 13, wherein determining the values of slack variables comprises:

solving for unknowns as slack variables associated with a Schur complement matrix on one of the processors.

15. The method of claim 13, wherein the back-solving comprises:

back-solving, in parallel, for any remaining unsolved ones of the unknowns, using the factors and the determined values.

16. The method of claim 10, further comprising:

repeating the computing, the constructing, the factoring, and the back-solving as Newton solution iterations to refine the values of the unknowns until residuals associated with the unknowns have been reduced below a first selected threshold value.

17. The method of claim 16, further comprising:

upon reducing the residuals associated with the unknowns in the network equations below the first selected threshold value, repeatedly testing for convergence in a global set of equations describing a reservoir associated with the network equations, to refine the values of unknowns in the global set of equations until residuals associated with the unknowns in the global set of equations have been reduced below a second selected threshold value.

18. The method of claim 10, wherein the inter-well subdivisions comprise cross-connections between the intra-well subdivisions.

19. The method of claim 10, further comprising:

publishing the values of at least some of the unknowns in graphical form on a display.

20. An article including a non-transitory machine-accessible medium having instructions stored therein for parallel processing multi-well network simulations, wherein the instructions, when accessed by a number of processors, result in a machine performing:

receiving formation and/or fluid property information from sensors positioned in a borehole that are operating in a first well which is included in a network that comprises a plurality of interconnected wells;

computing, in parallel, to determine values of unknowns in network equations for intra-well subdivisions of the network; and in response to determining values of unknowns in the network equations for the intra-well subdivisions, compute, in parallel, to determine values of unknowns in network equations for inter-well subdivisions of the network, wherein determining the values of the unknowns in the network equations for intra-well and inter-well subdivisions includes;

constructing a distributed Jacobian matrix having portions comprising coefficients of the unknowns, wherein said constructing includes distributing the portions among at least two of the processor, wherein said distributing includes distributing each of the portions to a particular one of the processors previously assigned to corresponding ones of the subdivisions, wherein a given processor of the plurality of processors associated with an intra-subdivision well only computes the coefficients of the unknowns which are local to the given processor;

at least partially factoring the Jacobian matrix to provide factors and solve some of the unknowns including at least one of pressures at nodes, fluid compositions at nodes, or flow rates at connections;

back-solving for any remaining unsolved ones of the unknowns, using the factors and the determined values; and adjusting operation of devices associated with the plurality of interconnected wells based on the values of unknowns in the network equations for intra-well subdivisions and inter-well subdivisions of the network.

21. The article of claim 20, wherein the instructions, when accessed, result in the machine performing:

accessing a message passing interface (MPI) library during the constructing, to communicate data between the subdivisions.

22. The article of claim 20, wherein the instructions, when accessed, result in the machine performing:

after the factoring, transmitting a complement matrix to a single processor included in the number of processors; and solving for the unknowns as slack variables associated with the complement matrix using the single processor.

23. The article of claim 20, wherein the instructions, when accessed, result in the machine performing:

repeating the computing, the constructing, the factoring, and the back-solving as a first series of Newton solution iterations; and solving a global set of equations describing a reservoir associated with the network equations as a second series of Newton solution iterations, in which each one of the second series of Newton solution iterations contains at least one of the first series of Newton solution iterations.

* * * * *